United States Patent [19]

Cooper

[11] 4,099,784

[45] Jul. 11, 1978

[54] METHOD AND APPARATUS FOR BREAKING HARD COMPACT MATERIAL SUCH AS ROCK

[75] Inventor: George A. Cooper, Gollion, Switzerland

[73] Assignee: Institut Cerac SA., Ecublens, Switzerland

[21] Appl. No.: 731,316

[22] Filed: Oct. 12, 1976

[30] Foreign Application Priority Data

Oct. 23, 1976 [CH] Switzerland ..... 13751/76

[51] Int. Cl.[2] ..... E21C 37/02

[52] U.S. Cl. ..... 299/10; 299/22; 299/23

[58] Field of Search ..... 299/20, 21, 22, 23, 299/10; 175/230

[56] References Cited

U.S. PATENT DOCUMENTS

| | | | |
|---|---|---|---|
| 385,655 | 7/1888 | Archer, Jr. | 299/20 |
| 2,634,113 | 4/1953 | Joy | 299/21 |
| 3,105,561 | 10/1963 | Kellner | 175/230 |
| 3,565,488 | 2/1971 | Walsh | 299/22 |

*Primary Examiner*—Ernest R. Purser
*Assistant Examiner*—William F. Pate, III
*Attorney, Agent, or Firm*—Flynn & Frishauf

[57] ABSTRACT

A method of breaking hard compact material such as rock adjacent a hole drilled thereinto and an apparatus for performing the method are described. Two forces contribute to efficiently breaking the rock: a force for firmly gripping a region of material adjacent the hole and an axial outwardly directed force. When breaking the material the force for firmly gripping the material is unidirectional with but separate from the axial outwardly directed force. To generate these forces wedge means and sleeve means of the apparatus are inserted into the hole and an axial outwardly directed thrust is exerted on the sleeve means by means of cooperating sliding wedge surfaces of the wedge means and sleeve means which converge towards the apparatus power means. This power means as well as the thrust transmitting means for transferring the reaction force are situated outside the hole.

12 Claims, 9 Drawing Figures

METHOD AND APPARATUS FOR BREAKING HARD COMPACT MATERIAL SUCH AS ROCK

The invention relates to a method and apparatus for breaking hard compact material such as rock adjacent a hole drilled thereinto and wherein a region of the material from the wall of the hole is first firmly gripped by a wedge effect, whereupon an outward axial force is applied to said gripped region of sufficient magnitude to cause breaking and pulling out of said region of material while the thrust reaction force incident to said axial force is taken up and neutralized by said material.

The method of breaking hard compact material such as rock can be applied, e.g., in driving tunnels, splitting boulders or pieces of rock, in flaking material from thick seams and so on.

In German patent specification No. 389,750 there is described a mechanical coal and rock breaker the purpose of which is to recover coal or rock in underground or aboveground mining without blasting it. The breaker which is introduced in a borehole applies a gripping force on coal or rock adjacent the borehole by means of breaker jaws while simultaneously an axial inwardly directed force is generated by the shaft of the breaker abutting against the bottom of the borehole.

However, it is not possible to control with this breaker the radial outwardly directed gripping force and the axially acting force independently from one another which is indispensable for a satisfactory breaking of rock or the like. Besides, no axial outwardly directed force is acting on the breaker jaws.

The apparatus for breaking rock adjacent a borehole according to USSR patent specification No. 259010 comprises two double-acting hydraulic cylinders. The first cylinder, which has the function of a material gripping cylinder, is provided with a piston and a piston rod with a conical surface at its end. The second cylinder, which is the actual working cylinder, comprises a piston and a piston rod which is also provided with a conical surface. On the drill rod there is fixed an abuttment in the form of rotatably affixed lugs having conical surfaces which cooperate with the conical surface of the piston rod of the second piston. All the conical surfaces converge toward the bottom of the borehole. The lugs exert a radial outwardly directed force on the hole wall when they are radially expanded.

The disadvantages of this solution are as follows. All the conical surfaces are aligned in a direction which is opposite to the optimal direction of the exploitation of the metal of the wedge and gripping means. In the apparatus according to the aforementioned USSR patent the direction of movement of the conical surfaces of both the piston rods is such that they are pressed toward the hole bottom whereas the sleeve elements are put in axial tension. Thus, when the rock is broken out by pulling out the sleeve elements axially, the maximum breaking force which can be exerted is comparatively small in order to break out the rock; this is because the sleeve elements are already tensioned in the axial direction and an additional force has to be applied in order to break the rock. In other words, the force applied on the conical surfaces to grip the material is not an additional force to break out the material, but instead actually causes a weakening of the radial outwardly acting force, resulting in a loss of efficiency.

An apparatus for breaking out a rock according to Swiss patent specification No. 286 398 is encircled by a fulcrum cone which is inserted with the apparatus into a borehole. During the boring of the hole the fulcrum cone bites into the hole wall by the effect of the impact of striking force, so that the rock will be gradually split. Even this fulcrum cone does not exert any axial outwardly directed force.

In published German patent specification No. 1,427,709 a device for boring or striking of holes in walls of different art and strength is described. This is carried out by means of cones which are introduced into drill bits to be wedged on, so that they can be used as wall plugs. This device is not used for breaking out rock and besides the cones do not exert any axial outwardly directed force.

According to French patent specification No. 1,285,370 a drilling apparatus having a conical cracking member is known. This cracking member is a body loosely mounted on a shaft which runs perpendicularly to the direction of movement of the drilling tool. When the drilling tool advances into the hole the conical surface of the cracking member presses against the hole wall and breaks it out. Such a cracking member does not exert any axial outwardly direction force and does not grip the hole wall.

The known machines are designed to perform a drilling operation as well as a breaking operation by exerting forces in the borehole. They are equipped for this purpose with outwardly radially expanding devices to grip the surrounding material. The main disadvantage of the known machines for breaking hard material such as rock consists in the fact that they comprise only an outwardly radially expanding device; they have no axially expanding device which could be used simultaneously with the drilling operation.

It is the object of the present invention to do away with the shortcomings of the known devices for breaking hard compact material such as rock and to provide a method and apparatus by means of which the hard material such as rock can be broken out from the wall of a borehole by exploiting the available forces and its metal parts in the optimal way.

SUMMARY OF THE INVENTION

Accordingly, a method for breaking hard compact material such as rock as described above is characterized by generating said force for firmly gripping the material to be broken, said force being unidirectional with but separate from said outwardly directed axial force. The apparatus to carry out this method comprises a first power means adapted to drive a wedge means into extensible sleeve means so as to expand said sleeve means radially outwardly to firmly grip a region of a material around a hole wall and a second power means adapted to exert an axial outwardly directed thrust on said sleeve means to draw it out of the hole, while the reaction force emanating from said axial thrust is transmitted to said material via a thrust transmitting member. The wedge means and the sleeve means have cooperating sliding wedge surfaces which converge towards said first power means, and said second power means and said thrust transmitting means for transferring the reaction force are situated outside the hole.

Both of these forces (the radial outwardly directed force and the axial outwardly directed force) are useful in efficiently breaking the rock. In addition, once the gripping means is firmly abutting against the hole wall, it may also be pulled axially outwards in the direction from the bottom of the hole to help the breaking process in the rock, which actually takes place — in spite of a first impression that, because of the wedge shape of the end of the gripping means, to pull the gripping means axially outwards would disengage it from the wedge means and cause it to be pulled out of the hole. It is thus to be stressed that in the present invention both the wedge means and the gripping means are subjected to a full loading in a direction axially outwards from the bottom of the hole and thus that the forces in both elements actively aid in the rock breaking process.

DETAILED DESCRIPTION

Figure 1:
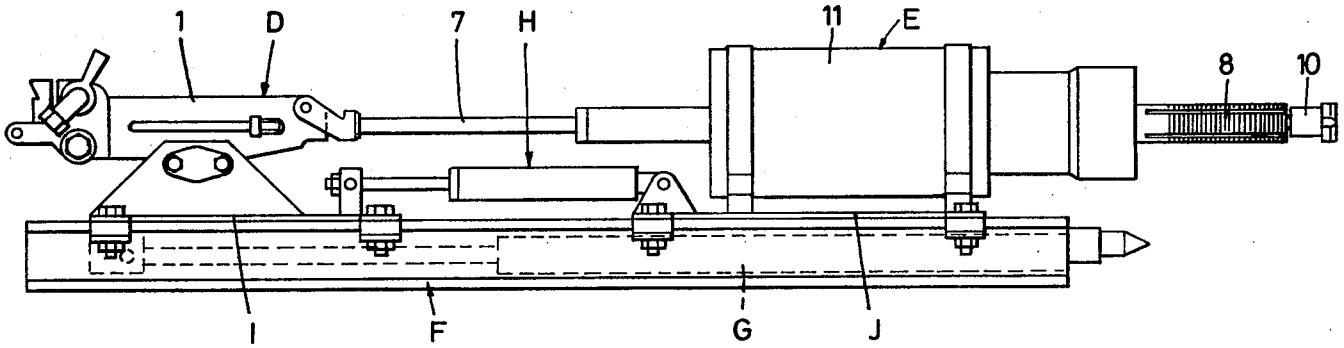
FIG. 1 is a schematic view of an apparatus for breaking a rock having a drilling machine and a breaking machine, both of them being movable on a rail.
Figure 2:
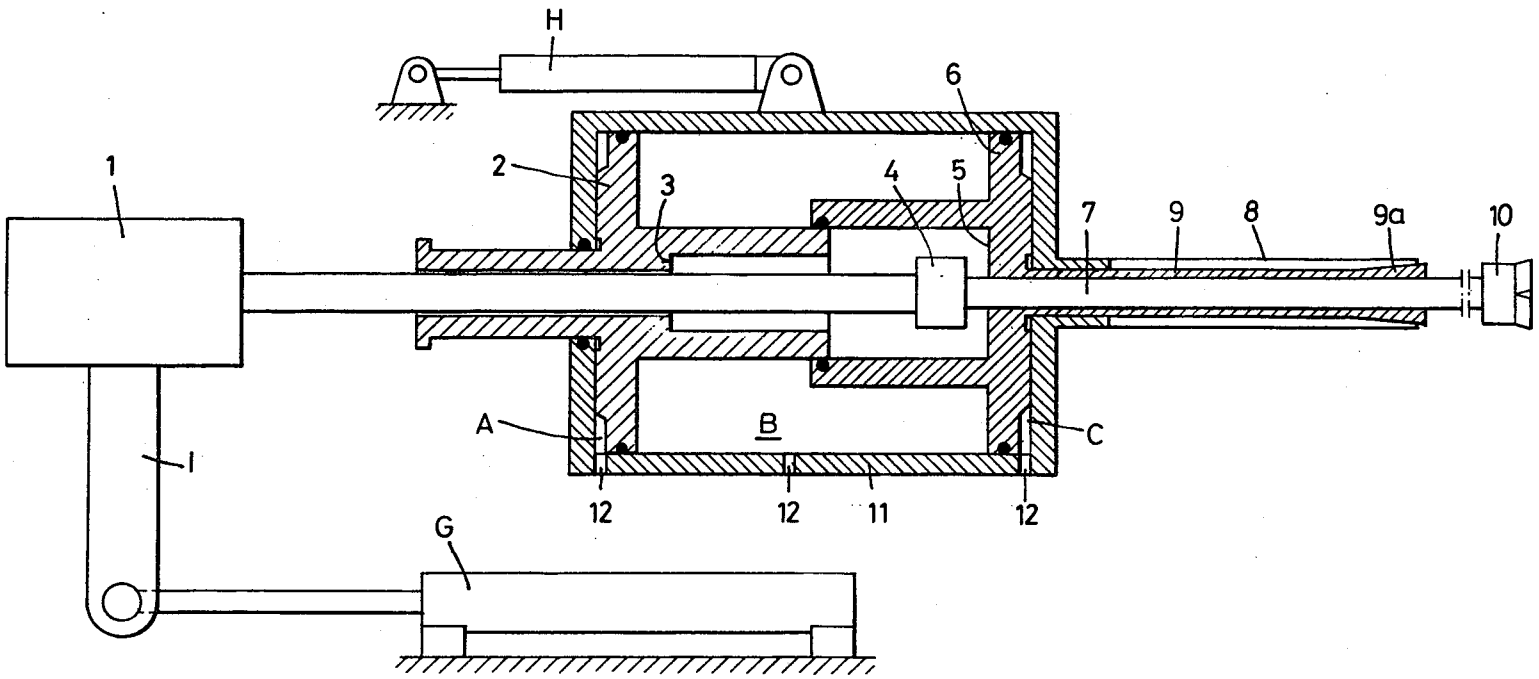
FIG. 2 is a schematic view of an apparatus for breaking a rock in section.
Figure 3A:
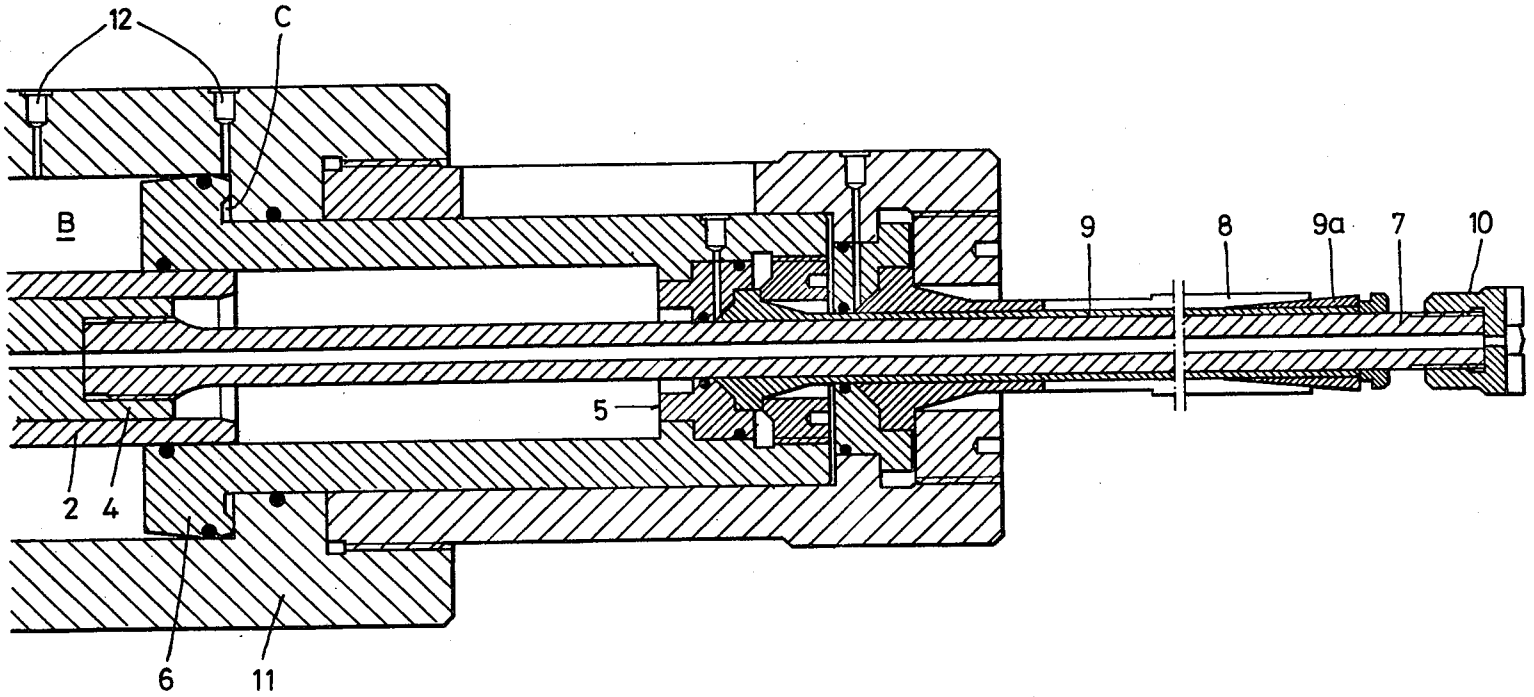
FIG. 3*a* is a partial sectional view of an embodiment of the apparatus according to FIG. 2.
Figure 3B:
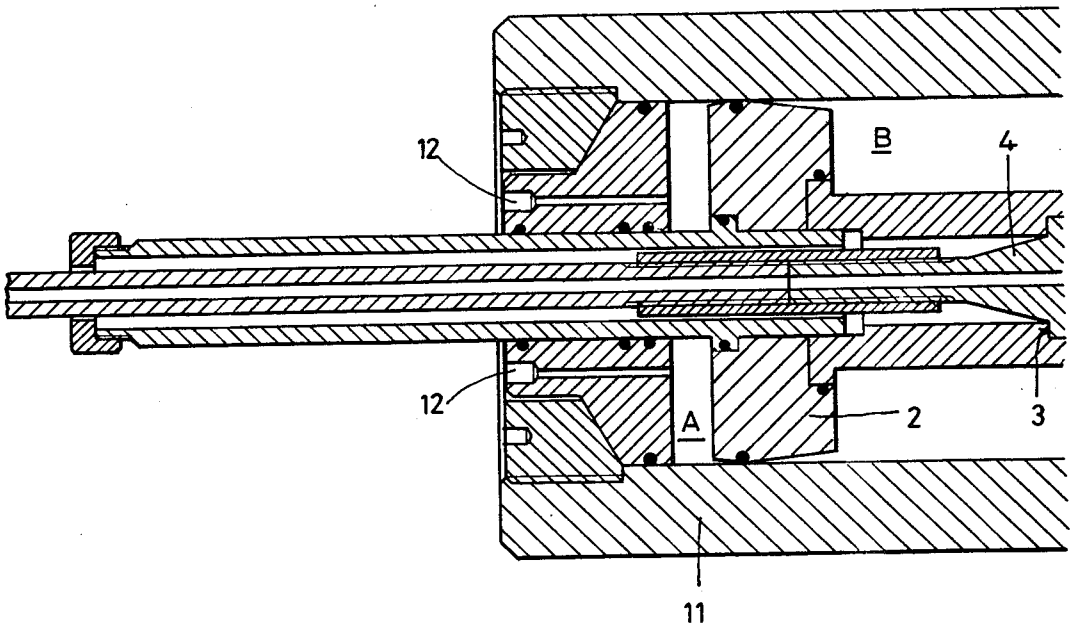
FIG. 3*b* is a partial sectional view of the rear part of the embodiment according to FIG. 3*a*.
Figure 4:
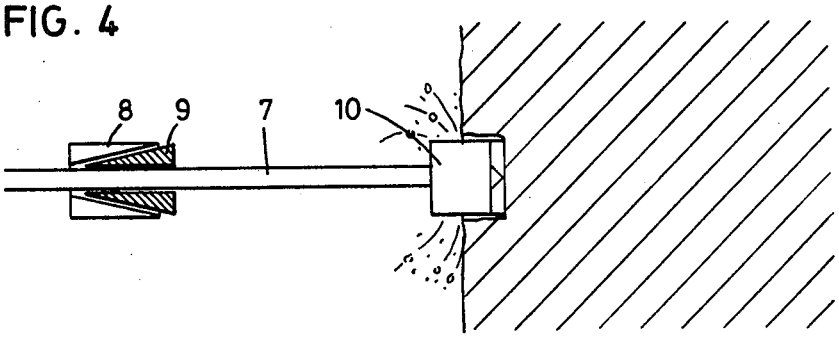
FIG. 4 is a schematic view of the apparatus at the beginning of the drilling process.
Figure 5:
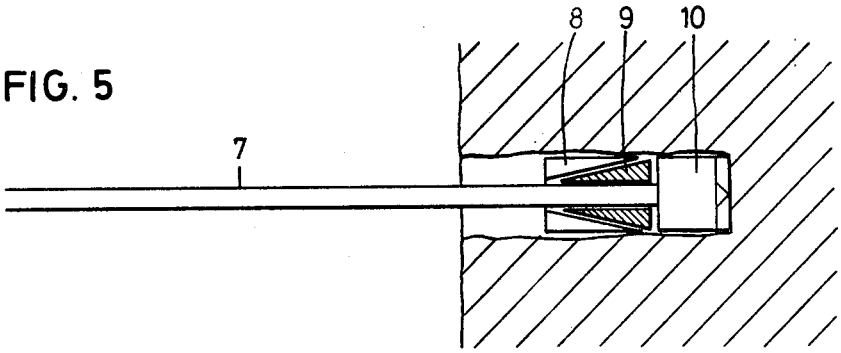
FIG. 5 is a schematic view of the apparatus in which the hole is drilled and the wedge means is introduced into the hole.
Figure 6:
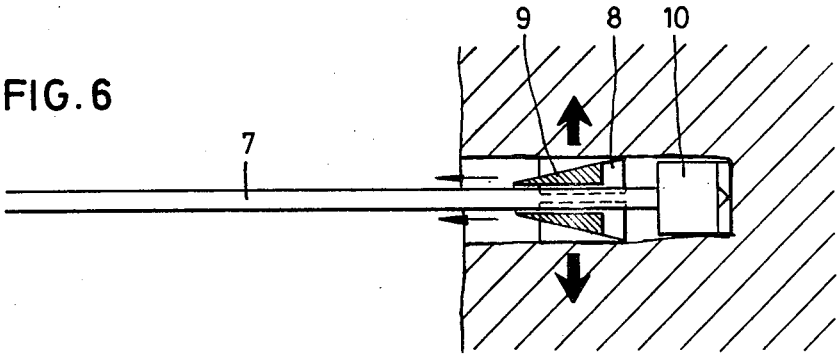
FIG. 6 is a schematic view of the apparatus in which the gripping means is pressed radially outwardly against the borehole wall by means of a radial outwardly directed force exerted on the wege means.

In order to drill a borehole in a rock and to break a region of material adjacent the borehole an apparatus is used which is schematically shown in FIGS. 1 and 2 and as a preferred embodiment on a larger scale in FIGS. 3*a* and 3*b*. The apparatus comprises a drilling machine D and a breaking machine E which are movable on a common rail F and double-action hydraulic cylinders G and H. The piston rods of cylinders G and H are connected via a plate I carrying the drilling machine D. The cylinder G is fixed to the rail F and the cylinder H is fixed to the carrying plate J of the breaking machine E. By actuating the cylinder G both the machines D and E are brought towards or away from the rock face after their distance from the rock face has been previously adjusted. By actuating the cylinder H the piston rod 7 is brought in its extreme forward position or the breaking machine E is brought to the rock face.

The drilling action can be performed by a separate drilling machine or by the drilling machine D shown in FIGS. 1–3*b*. This drilling machine comprises a central drill rod 7 extending through a hydraulic cylinder housing 11, which rod 7 is connected at its one end with a motor 1 by means of which it is rotated about the longitudinal axis of the housing 11. The central drill rod 7 is provided at its end opposite to the driving motor 1 with a drilling bit 10. A gripping means 8 in the form of a split sleeve is attached to the body of the housing 11 opposite to the driving motor 1.

As shown in FIG. 2, in the cylinder housing 11 there are slidably positioned two pistons 2 and 6. Both the pistons 6 and 2 are differential pistons; the stem of the second piston 2 is slidingly received in the first piston 6 and the heads of both the pistons 6 and 2 are slidingly disposed in the communicating cylinder bores. The first piston 6 comprises a wedge sleeve 9 which has at its remote end a conical end piece 9*a*. The wedge sleeve 9 with its conical end piece 9*a* is axially shiftable within the gripping means 8. The conical end piece 9*a* of the wedge sleeve 9 is placed forwardly of the gripping means 8 so that it causes the expansion of the gripping means 8 radially outwardly when the wedge sleeve 9 is urged by the piston 6 towards the cylinder housing 11.

The drill rod 7 is free to rotate within the wedge sleeve 9 and both the pistons 6 and 2, and to move longitudinally within the limits imposed by stops 3 and 5 on a collar 4 attached to the drill rod 7. The stops 3 and 5 are respectively formed by the second piston and the first piston, the collar 4 lying between both said pistons.

Chambers A, B, C are defined by both the pistons 2 and 6, see FIGS. 3*a* and 3*b*. Each of the chambers A, B, C is provided with a pressure fluid inlet and outlet 12.

By introducing pressure fluid into the chamber A the piston 2 which is separate from the drill rod 7 will engage the collar 4 of the drill rod 7 in such a way that the collar 4 comes in abutment with the stop 3. Due to the increased volume of the pressure fluid in the chamber A the piston 2 with the drill rod 7 and the drill bit 10 will be moved toward the working face, in this case the bottom of a not shown borehole. In this way an axial thrust will be exerted on the bottom of the hole.

When pressure fluid is introduced into the chamber C the piston 6 will be moved by increased volume of the pressure fluid in the chamber C in a direction away from the working face, the wedge sleeve 9 being moved along with the piston 6. In this way the wedge sleeve 9 with its conical end piece 9*a* is withdrawn inside the split gripping means 8 which, by a wedging action, exerts a radial thrust in the rock adjacent the hole so as to produce radial cracks in the wall of the borehole.

In this way the rock is gripped. When additional pressure is then applied to the pressure fluid in chamber A the split gripping means 8 with the wedge sleeve 9 withdrawn inside the split gripping means 8 is moved axially outwards of the hole, i.e., in the opposite direction from the bottom of the borehole, whereby the region of the gripped material is pulled out.

Accordingly, pressure may be applied to the chambers A and C simultaneously or in sequence. Applying pressure to the chamber C has the effect of making the split gripping means 8 grip the wall of the borehole, while the application of pressure to the chamber A has the effect that the drill rod 7 exerts an axial thrust on the bottom of the borehole. Consequently, cracks are produced in the wall of the borehole which are perpendicular to the axis of the borehole, and hence parallel to the free surface.

As mentioned above it will be achieved by the above-described method and apparatus that the face of the rock can be pulled out in flat flakes along the longitudinal axis of the apparatus.

The drilling action by rotating the bore drill 7 about the longitudinal axis of the cylinder housing 11 can be performed simultaneously with the above-described gripping action or both actions can follow independently of each other. The latter will be carried out in such a way that the drill rod 7 will be shifted axially in said cylinder housing 11 independently in advance of the piston 2 for a distance which is at least equal to the actual length of the gripping means 8.

The wedge sleeve 9 and the gripping means 8 may be introduced into the borehole during or after the drilling. Once the central drill rod 7, the wedge sleeve 9 and the split gripping means 8 are in the borehole, the apparatus may be made — besides drilling actions — to exert radial as well as axial forces on the rock.

By introducing the pressure fluid into the chamber B which lies intermediate the pistons 6 and 2 the pistons will be pushed away from each other, whereby the stop 3 of piston 2 comes out of engagement with the collar 4, the drill rod 7 ceasing the axial thrust on the bottom of the borehole, and the piston 6 with its wedge sleeve 9 will be moved toward the working face, ceasing the wedging engagement of the conical end piece 9*a* with the wedged surface of the gripping means 8 and so the gripping action of the latter on the wall of the borehole.

Figure 7:
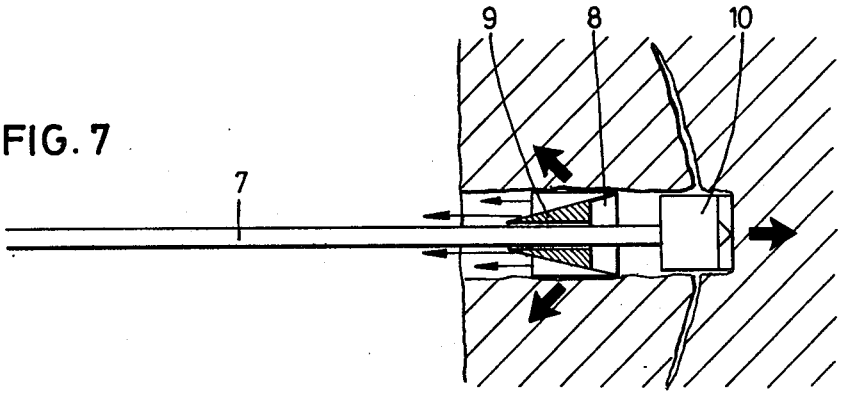
FIG. 7 is a schematic view of the apparatus in which axial outwardly directed forces are exerted on the wedge and gripping means and an additional radial outwardly directed force on the gripping means.

FIGS. 4 to 7 show the operation during the drilling of a borehole, introducing of the gripping means 8 and the wedge means 9 in a ready made borehole and the effect of the individual forces. It can be seen in FIG. 6 how a radial force is exerted on the hole wall by means of gripping means 8 into which the wedge means 9 with its conical end 9*a* has been withdrawn. In this phase the gripping means 8 abut against the wall of the borehole. During further withdrawing of the conical end 9*a* into the gripping means 8 the conical surfaces of both the elements are clamped. Now, the axially inwardly directed force of the drill rod 7 simultaneously with the radially outwardly and the axially outwardly directed forces act on the wall of the borehole, to which forces the gripping means 8 is exposed. This phase of the tearing of the rock is shown in FIG. 7.

Figure 8:
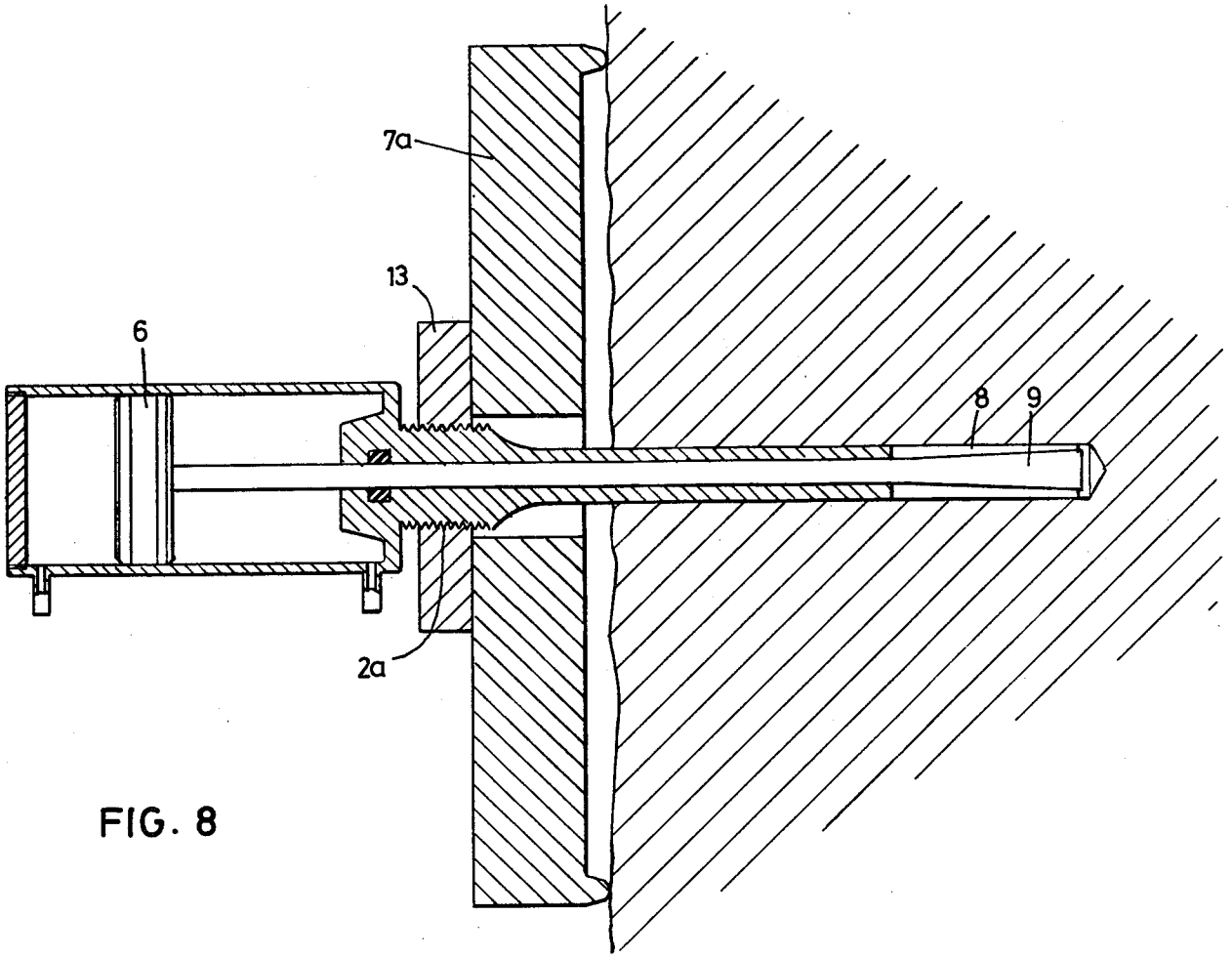
FIG. 8 shows another embodiment of the apparatus according to FIG. 2.

FIG. 8 shows an embodiment of the apparatus having a yoke 7*a* abutting against the rock adjacent the borehole which replaces the drill rod 7 of the previous embodiment transferring the axial inwardly directed force. By means of this yoke a reaction force is exerted on the rock. The conical end 9*a* is in a direct connection with the first piston 6 whereby the function of the second piston is carried out by a threaded portion 2*a* on an extension of the cylinder housing within a mechanical way, with which winding threaded portion the thread of a nut 13 of a winch (not shown) is in engagement. The extension of the cylinder housing passes into gripping means 8.

The connection between the second piston 2 or its substitution 2*a* and the member 7, 7*a* for transmitting the axial inwardly directed force is situated with all embodiments outside the borehole.

Because the pulling force which is exerted on the wall of the borehole by the sum of the tractions in the wedge sleeve 9 and the gripping means 8 must be balanced by the axial thrust in the drill rod 7, the sum of the cross-sectional areas of the first two will equal the cross-sectional area of the drill rod 7 (for steels of the same quality) and each will represent half of the cross-sectional area of the borehole. The observation of these design principles will result in an optimized design in which the maximum possible forces are transmitted through the borehole, and are used usefully to load the rock, since the whole cross-sectional area of the hole can be filled with steel which can be stressed to its maximum in developing loads which are all useful in rock breaking.

With the above-mentioned machine not only a radial compressive stress will be developed in the walls of the borehole, but also a tensile stress is generated on a plane normal to the hole axis between the drilling bit 10 and the bottom of the gripping means 8. Thus, hard material such as rock which is much weaker in tension than compression, tends to fail by the formation of a flake normal to the hole axis. The radially outwardly directed force causes predominantly a compressive thrust whereas the axially directed force causes predominantly a tensile thrust on the wall or the bottom of the borehole.

With the rock-breaking apparatus, such as described in the present application, the energy used to drill the hole is much greater than that used to break the rock. In experiments with hard rocks, such as granite, it was found that 10 times as much energy is required to drill the hole as is needed by the rock breaker to break and to remove the rock. It is thus clear that an efficient apparatus of the type discussed here should exert the maximum of force useful to the rock-bearing process in a hole of the smallest cross-sectional area. The forces which are most useful to the rock-breaking process are the outwardly directed axial thrust applied to the gripping means assisted by the radially outwardly directed force also applied to the gripping means. This force is in addition therefore necessary as it prevents the gripping means from sliding on the walls of the borehole. The axial inwardly directed force applied to the central thrust transmitting member is necessary to achieve a force-balance, and is of course exactly equal, but of opposite sense to the force applied to the gripping means and the wedge means.

It is advantageous with the above-mentioned apparatus that firstly the central drill rod is used to transmit axial forces for rock breakage, and secondly that the gripping forces on the gripping means act in a sense which is opposed to that of the axial forces. By the arrangement of the drill rod acting simultaneously as a transmitting element of the axial force, the cross-sectional area of which is to that of the wedge sleeve and the gripping means, a maximum diameter for transmitting the maximum forces is achieved.

What is claimed is:

1. In a method of breaking hard compact material such as rock adjacent a hole drilled thereinto, comprising first firmly gripping a region of the material from the wall of the hole by a wedge effect under the influence of a force applied to a wedging means; the improvement comprising:

then applying an axial force directed outwardly of said hole to said gripped region of sufficient magnitude to cause breaking and pulling out of said region of material;

said outwardly directed axial force being exerted under the influence of a further force which is unidirectional with but separate from said force producing said outwardly directed axial force; and taking up and neutralizing the thrust reaction force incident to said outwardly directed axial force by said material.

2. Apparatus for breaking hard compact material such as rock adjacent a hole drilled thereinto, comprising:

an expandable sleeve means;

a wedge means;

a first power means for driving said wedge means into said expandable sleeve means while said wedge and sleeve means are in said hole to expand said sleeve means radially outwardly to firmly grip a region of a material from a hole wall; and a second power means for exerting an axial outwardly directed thrust on said sleeve means to draw it out of the hole, said second power means being situated outside the hole;

a thrust transmitting member;

a thrust transmitting means coupled to said thrust transmitter member for transmitting the reaction force emanating from said axial thrust to said material via said thrust transmitting member, said thrust transmitting means being situated outside the hole;

said wedge means and said sleeve means having cooperating sliding wedge surfaces which converge towards said first power means.

3. Apparatus according to claim 2, wherein said thrust transmitting member extends integrally through said sleeve means into abutting relation with the hole bottom, said wedge means being slidingly supported on said thrust transmitting member peripherally between thrust transmitting member and said sleeve means.

4. Apparatus according to claim 2, wherein said thrust transmitting member is a drill rod having a drill bit, said apparatus including means for actuating said drill rod to drill a hole into said material prior to breaking the material adjacent the hole with said drill bit abutting against the hole bottom.

5. Apparatus according to claim 2, comprising a hydraulic cylinder housing; and wherein said first power means and said second power means comprise respective pistons slidable in said cylinder housing, said pistons defining in said cylinder housing three chambers, each chamber having a separate fluid inlet and outlet;

said sleeve means is connected to said cylinder housing, and said wedge means is connected to said first power means.

6. Apparatus according to claim 5, wherein said thrust transmitting member comprises a collar thereon, said collar being arranged between said first and said second power means and being engaged by said second power means.

7. Apparatus according to claim 6, wherein said thrust transmitting member comprises a drill rod, said drill rod being moveable in a forward direction relative to said second piston for advancing said drill rod for a distance at least equal to the axial hole penetrating length of said sleeve means.

8. Apparatus according to claim 5, wherein said pistons are differential pistons each having a forwardly directed stem portion thereon, the stem portion of said second piston being slidingly received in said first piston.

9. Apparatus according to claim 2, wherein said thrust transmitting member comprises a yoke straddling said hole, said yoke supporting said first and second power means thereon and applying said axial inwardly directed thrust to said material in laterally spaced relation to said hole.

10. Apparatus according to claim 9, wherein said yoke is situated outside said hole.

11. Apparatus according to claim 2, wherein said sleeve means comprises a split cylindrical sleeve portion; and said wedge means is slidably mounted within said sleeve means and has a wedging surface engageable with said split cylindrical sleeve portion to outwardly expand said split cylindrical sleeve portion.

12. Apparatus according to claim 3, wherein said sleeve means comprises a split cylindrical sleeve portion; and said wedge means is slidably mounted within said sleeve means and has a wedging surface engageable with said split cylindrical sleeve portion to outwardly expand said split cylindrical sleeve portion.

* * * * *

UNITED STATES PATENT AND TRADEMARK OFFICE

CERTIFICATE OF CORRECTION

PATENT NO. : 4,099,784

DATED : July 11, 1978

INVENTOR(S) : George A. COOPER

It is certified that error appears in the above-identified patent and that said Letters Patent are hereby corrected as shown below:

On the initial page of the patent, change the date of the priority application from "October 23, 1976" to --October 23, 1975--.

Signed and Sealed this

*Thirteenth* Day of *February 1979*

[SEAL]

*Attest:*

RUTH C. MASON
*Attesting Officer*

DONALD W. BANNER
*Commissioner of Patents and Trademarks*